United States Patent [19]

Gover

[11] Patent Number: 4,691,539

[45] Date of Patent: Sep. 8, 1987

[54] BAND SECURITY LOCK

[76] Inventor: Gary W. Gover, 630 N. 2nd St., Lakeview, Oreg. 97630

[21] Appl. No.: 830,729

[22] Filed: Feb. 19, 1986

[51] Int. Cl.[4] ..... E05B 73/00

[52] U.S. Cl. ..... 70/18; 70/49; 70/233

[58] Field of Search ..... 70/18, 30, 49, 58, 233, 70/234; 242/77, 77.2, 77.3, 78.8, 107, 107.12, 107.2, 107.3, 107.4 R, 107 L

[56] References Cited

U.S. PATENT DOCUMENTS

| | | | |
|---|---|---|---|
| 2,574,967 | 11/1951 | Gossner | 70/49 |
| 3,981,166 | 9/1976 | Madonna | 70/234 |
| 4,033,160 | 7/1977 | Mima | 70/49 |
| 4,086,795 | 5/1978 | Foster | 70/49 |

FOREIGN PATENT DOCUMENTS

| | | | |
|---|---|---|---|
| 115887 | 12/1900 | Fed. Rep. of Germany | 70/49 |

*Primary Examiner*—Robert L. Wolfe

*Attorney, Agent, or Firm*—Klarquist, Sparkman, Campbell, Leigh & Whinston

[57] ABSTRACT

A band lock device that utilizes a steel band wound around a spring mechanism enclosed inside a compact housing. The band has attached to its free end, the second element of a two part lock mechanism with the locking device itself enclosed inside the housing. Operationally, the band is extended outside the housing, secured around item being protected, then inserted back into opposite side of housing into the lock mechanism. As the security key is turned engaging the lock, the remaining steel band coiled in the housing is compressed between two internal structures rendering the remaining coiled band stationary until the lock mechanism is released.

12 Claims, 4 Drawing Figures

FIG.1
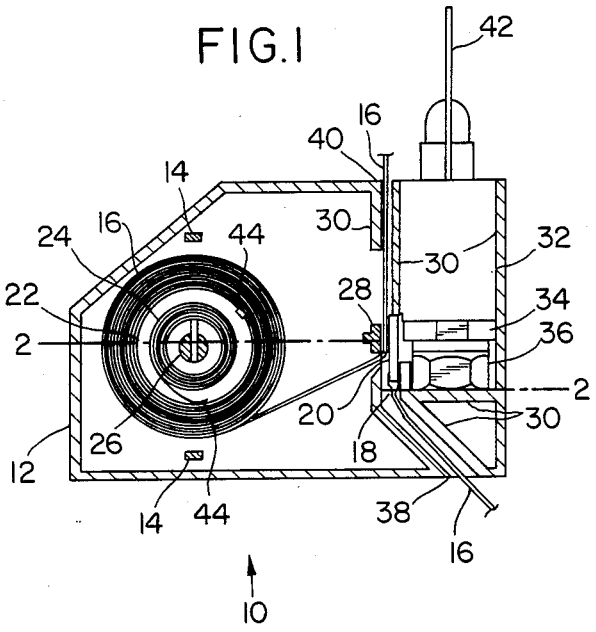
FIG.2
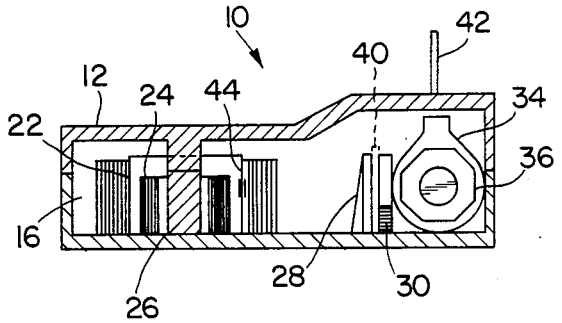
FIG.3
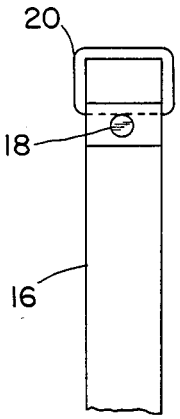
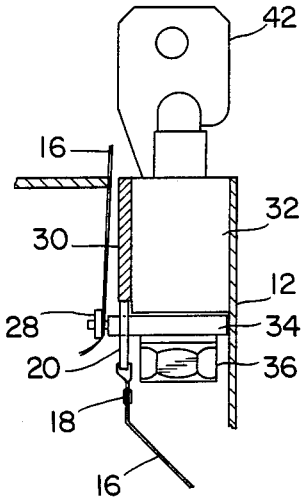
FIG.4

BAND SECURITY LOCK

BACKGROUND OF THE INVENTION

1. Field of the Invention

The invention relates generally to a device that serves as a locking system to secure skis and bicycles from theft.

2. Description of the Prior Art

Ski locking devices are designed to do basically the same function; secure skis from theft. But because of current designs, shapes and mechanisms most are large, bulky and uncomfortable to carry on one's person. Subsequently, they are seldom carried when they're needed most often. This device, in using a steel band rather than a cable or shackle and having a very compact design, eliminates that problem.

SUMMARY OF THE INVENTION

The Invention is a security lock which utilizes a stainless steel band for use as a shackle to secure skis or bicycles. The retractable steel band is pulled from the housing, wrapped around the object to be locked and then inserted back into the housing where it is then locked into place.

The object of this invention is to provide locking security with a stainless steel band while utilizing a compact, high strength housing design for convenience and low cost.

BRIEF DESCRIPTION OF THE DRAWING

FIG. 1 is a sectional view showing an embodiment of the band security lock.

FIG. 2 is a sectional view taken along line 2 of FIG. 1.

FIG. 3 is an elevated view of steel band and anchor clip.

FIG. 4 is a fragmentary view of the lock mechanism and its complimentary components.

DESCRIPTION OF THE PREFERRED EMBODIMENTS

In reference to FIGS. 1, 2, 3, and 4, the band security lock 10 is molded in a geometric shape from a high strength material for resistence to extreme weather conditions and physical abuses. The housing 12 comprises various internal structures primarily for strength and band routing purposes. The bumpers 14, positioned opposite each other, function as barriers to keep the steel band 16 wound relatively tight. At the center of the housing extends a molded circular support member 26 for housing strength and as an attachment point for the spring steel 24. Band guides 30 positioned through the housing act as routing guides for band exit as well as band entry into housing. The steel band 16 will exit the housing through the exit opening 40 and be inserted back into the housing through the entry opening 38. The exit and entry openings are rectangular shaped slots in the side of the housing 10. However, the entry opening 38 is wider than the exit opening 40 in order to accommodate the anchor clip 20. The entry opening 38 and the adjacent band guides 30 are angled 45 degrees to eliminate tampering with the cam 34 by an object inserted into the opening. The housing 12 is molded as two pieces and bonded together during assembly. The five sided design of the housing 12 produces a flat plane on each of the five surfaces for an enhanced fit to any surface being locked. This allows the band security lock to be engaged using any of its five sides.

The steel band 16, which has a steel anchor clip 20 attached to its free end by means of a fastener 18 as shown in FIG. 3, will be wound around and attached to the retainer reel 22 by means of a rivet 44 extending through the end of the steel band 16 and into the retainer reel 22. Inside the retainer reel 22, a spring steel 24 is coiled around the support member 26 with one end of the spring steel inserted into a slot in the support member 26. The other end of the coil is attached to the inside of the retainer reel 22 by means of a rivet 44. The spring steel 24 provides the means by which the steel band 16 is retracted back into the housing 12 and wound around the retainer reel 22. Band guides 30 molded inside the housing 12 will route the band both as it exits and enters. As the steel band 16 moves towards the exit opening 40, it passes over the compression post 28 which is positioned opposite the cam 34 as shown in FIG. 1. As the steel band 16 is allowed to retracted back into the housing 12, the spring steel 24 rewinds turning the retainer reel 22 in a clockwise motion which winds the steel band 16 around the retainer reel 22 coming to a stop when the anchor clip 20 rests in the mouth of the exit opening 40.

The lock mechanism 32 is secured by a threaded nut 36 as the entire lock assembly is enclosed inside the housing 12 by band guides 30. The circular lock mechanism 32 extends to the outer edge of the housing so that the lock surface and the housing surface are flush as shown in FIGS. 1 and 4. A round tube type security key 42 is used with this lock mechanism 32. The lock mechanism 32 is a cam type in which the cam 34 moves simultaneously and in the same direction as the key 42. The lock mechanism 32 is shown in the unlock position in FIGS. 1 and 2. Conversely, it is shown in the locked position in FIG. 4.

Operationally, this device works as follows. The steel band 16 is pulled out of the housing 12, extended around the property being secured, most notably skis or bicycles, then the band is inserted back into the housing through the entry opening 38 until the anchor clip 20 comes to a stop against the band guide 30 as shown in FIG. 4. The steel band 16 is then allowed to retract from the force of the coiled spring steel 24 until the property being secured is held firmly. Then, as the key 42 is turned 90 degrees in a clockwise direction, the cam turns in a 90 degree arc in a clockwise direction extending through the anchor clip 20 and coming to stop against the compression post 28 with the steel band compressed between the compression post 28 and cam 34, thus eliminating further retractibility while locking the steel band 16. This is shown in FIG. 4. At this stage, the property is secure with the benefit of a steel band and security lock mechanism.

What I claim is:

1. A shackle-type security lock for skis, bicycles and the like comprising:

a thin, flat housing including edge surfaces, a bi-directional reel rotatably mounted within said housing, said reel mounting a coil of thin, flexible metal shackle band and being spring-biased in a band-coiling direction, said band having a free end including an anchor clip comprising a locking eye, said housing including means defining a band exit slot and a band entrance slot in said edge surfaces and an internal guideway for guiding said locking eye through said entrance slot toward a predetermined locking position within said housing, means defining a compression surface within said housing adjacent said locking position, said band being trained about said compression surface enroute from said reel to said exit slot, key-operated locking means within said housing operable with a key from without said housing, said locking means including a locking member movable by operation of said key between (a) an unlocked position retracted from said compression surface and locking position in which said band can be freely withdrawn from said housing through said exit slot and said locking eye can be freely withdrawn from said locking position through said entrance slot, and (b) a locked position in which said locking member extends through said locking position and toward said compression surface to extend through said locking eye when at said locking position and compress said band against said compression surface, whereby said locking member in said locked position prevents both withdrawal of said locking eye from said housing through said entrance slot and said band from said housing through said exit slot.

2. The device of claim 1 wherein said housing has a generally polygonal shape with straight flat edge surfaces, said entrance and exit slots being in different ones of said edge surfaces.

3. The device of claim 2 wherein said polygonal shape is an irregular five-sided polygon, four of said five sides meeting at right angles, the fifth said side meeting its adjacent sides at obtuse angles, said entrance and exit slots being in two of said four sides.

4. The device of claim 1 wherein said key-operated locking means has a keyway at one of said edge surfaces.

5. The device of claim 1 wherein said guideway extends from said entrance slot at an obtuse angle to the edge surface containing said entrance slot.

6. The device of claim 1 wherein said guideway includes a first guideway portion extending from said entrance slot at a first angle to the edge surface containing said entrance slot and a second guideway portion extending from an intersection with said first guideway portion toward said locking position at an angle to said first guideway portion so as to restrict access to said locking position from outside said housing.

7. The device of claim 1 wherein said locking member comprises a camming surface rotatable through said locking eye to compress said band against said compression surface.

8. The device of claim 1 wherein said locking eye is generally rectangular in shape and is sized to receive said locking member.

9. The device of claim 1 wherein said compression surface comprises a portion of a compression post within said housing, said surface lying in the path of travel of said locking member in its movement between said locked and unlocked positions.

10. The device of claim 1 including abutment means within said housing in the path of travel of said locking eye along said guideway to block movement of said locking eye inwardly of said entrance slot beyond said locking position.

11. The device of claim 1 including coil retention means within said housing for retaining said band in a tightly coiled position on said reel by restraining said coil against expansion beyond a predetermined diameter.

12. The device of claim 1 wherein:

said key-operated locking means has a keyway at one of said edge surfaces, said means defining said guideway includes a first guideway portion extending from said entrance slot at a first angle to the edge surface containing said entrance slot and a second guideway portion extending from said first entrance guideway portion toward said locking position at an angle to said first guideway portion, and abutment means blocking the path defined by said guideway portions to restrain said locking means against movement inwardly of said housing along said path beyond said locking position.

* * * * *